US012203282B2

(12) United States Patent
Smith

(10) Patent No.: US 12,203,282 B2
(45) Date of Patent: Jan. 21, 2025

(54) GROUND ANCHOR COLLAR AND ASSEMBLY

(71) Applicant: Richard Smith, Euless, TX (US)

(72) Inventor: Richard Smith, Euless, TX (US)

( * ) Notice: Subject to any disclaimer, the term of this patent is extended or adjusted under 35 U.S.C. 154(b) by 224 days.

(21) Appl. No.: 18/081,798

(22) Filed: Dec. 15, 2022

(65) Prior Publication Data

US 2024/0200353 A1 Jun. 20, 2024

(51) Int. Cl.
*E04H 12/20* (2006.01)

(52) U.S. Cl.
CPC ..... *E04H 12/20* (2013.01)

(58) Field of Classification Search
CPC ..... E02D 5/80; E02D 5/801; E02D 5/803; E02D 5/805; E04H 12/20; E04H 12/2215; E04H 12/2223; E04H 12/223; E04H 12/2238; E04H 12/2284; F16L 3/02; F16L 3/08; F16L 3/10; F16L 3/1008; F16L 3/1016; F16L 3/0125; F16L 3/1041; F16L 3/105; F16L 3/1091; F16L 3/1211
USPC ..... 248/413, 222.14, 218.4
See application file for complete search history.

(56) References Cited

U.S. PATENT DOCUMENTS

| | | | | |
|---|---|---|---|---|
| 2,962,112 | A | 11/1960 | Ramsberger | |
| 3,220,766 | A | 11/1965 | Kates | |
| 3,295,274 | A | 1/1967 | Fulton | |
| 4,007,807 | A | 2/1977 | Pogwizd | |
| 4,699,248 | A | 10/1987 | Roy | |
| 5,078,231 | A | 1/1992 | Davis | |
| 5,463,834 | A * | 11/1995 | Krieger | E02D 5/803 D30/154 |
| 6,352,391 | B1 * | 3/2002 | Jones | E02D 5/801 405/253 |
| 6,682,267 | B1 * | 1/2004 | Jones | E02D 35/00 405/253 |
| 7,497,404 | B1 * | 3/2009 | Fullan | F16L 3/1211 138/108 |
| 8,418,809 | B2 | 4/2013 | Donlon | |
| 8,464,834 | B2 | 6/2013 | Blazin et al. | |
| 8,887,867 | B2 | 11/2014 | Blazin et al. | |
| 10,352,014 | B1 | 7/2019 | Baptiste | |
| 2004/0105727 | A1 * | 6/2004 | Jones | E02D 35/00 405/252.1 |
| 2005/0199867 | A1 * | 9/2005 | Fordyce | E04H 17/22 256/65.14 |
| 2011/0194901 | A1 * | 8/2011 | Jones | E02D 5/801 405/252.1 |

(Continued)

*Primary Examiner* — Kyle J. Walraed-Sullivan
(74) *Attorney, Agent, or Firm* — Brian K. Yost; Decker Jones, PC

(57) ABSTRACT

The ground anchor assembly comprises a collar, a T-post, a guy line, and a guy line attachment member. The guy line attachment member is coupled to the guy line. The collar comprises a perimeter wall and an adjustment member. The perimeter wall defines an internal void adapted to receive a portion of the T-post such that when the T-post is positioned within the internal void, the perimeter wall surrounds a perimeter of the portion of the T-post and restrains rotational movement of the collar relative to the T-post. The adjustment member is moveable from a first position to a second position, the first position being one in which a distal end of the adjustment member does not contact the T-post, the second position being one in which distal end contacts the T-post between adjacent stubs of the T-post.

11 Claims, 7 Drawing Sheets

(56) References Cited

U.S. PATENT DOCUMENTS

2023/0106901 A1* 4/2023 Von Deylen ..... E04H 12/2223
405/237

* cited by examiner

GROUND ANCHOR COLLAR AND ASSEMBLY

BACKGROUND OF THE INVENTION

1. Field of the Invention

The present invention relates generally to an anchoring system and specifically to a ground anchor collar and assembly adapted to secure a platform, container, tent, or other structure to the ground.

2. Description of the Prior Art

It is often necessary to secure platforms, containers, tents, airplanes, and other structures in place by use of pegs or stakes which are driven into the ground and connected to the object to be secured by a chain, rope, or similar connection device. However, because conventional stakes often dislodge because of wind, vibration, or other structure movement, a number of attempts have been made to provide improved anchoring systems. For, example, U.S. Pat. No. 4,007,807 Pogwizd, provides an anchor for a ladder having an anchor stake secured by a chain to eye rings embedded in the ladder. U.S. Pat. No. 3,295,274, Fulton provides a helical screw anchor secured to a leg by a chain and collar clamp. U.S. Pat. No. 4,699,248, Roy, discloses an observation stand with a guy line, chain, and turnbuckle arrangement extending to the ground, and anchored by stakes. U.S. Pat. No. 2,962,112, Ramsberger provides a ladder structure with anchor stakes secured to the legs by a hook. U.S. Pat. No. 5,463,834, Krieger, discloses a tethering stake with a swingable barb-like portion, the stake being connected to a chain. U.S. Pat. No. 8,418,809, Donlon, shows staked receptacles for the feet of a ladder. U.S. Pat. Nos. 8,887,867 and 8,464,834, both to Blazin, show a ladder anchoring system having a stake secured to a ladder rung by arms. U.S. Pat. No. 10,352,014, Baptiste shows a screw anchor for the ground. U.S. Pat. No. 3,220,766, Kates, shows a stand having stakes at the bottom of the legs. U.S. Pat. No. 5,078,231, Davis, shows a base for a ladder, having a plate on the ground and chains that hook the plate to a bottom rung. U.S. Pat. No. 8,113,473, Bradley, shows a "T" post mounting system.

Although the prior art anchoring systems are adequate for their intended uses, they each have drawbacks in terms of ease of use, stability, adjustability, strength, and cost. There is a need for a device that can be quickly used, with only simple tools, to anchor platforms, containers, tents, airplanes, or other structures to the ground. Such a needed invention would be easy to use, fully adjustable, relatively inexpensive, and easy to transport and store. The present invention accomplishes these objectives by providing a rigid, long lasting clamp that fits over any standard ranch or farm steel "T" post found on millions of locations across the United States. To install requires only a standard "T" post driver and a wrench.

SUMMARY OF THE INVENTION

The ground anchor assembly of the preferred embodiment generally comprises a collar, a guy line, and a stake. The collar of the preferred embodiment comprises a perimeter wall, an adjustment member, and a guy line attachment member. The perimeter wall defines an internal void (hollow portion) adapted to receive and surround a perimeter of the stake. In preferred embodiments, inner surfaces of perimeter wall are arranged to engage a leg and arms of a T-shaped stake. Inner surfaces of the perimeter wall restrain the collar from substantial rotation relative to the stake. In certain embodiments, the internal void is shaped as a negative of the top end of the stake. Thus, for example, in embodiments in which the stake is multisided, the internal void may also be multisided. Though a round stake is not preferred because it is more difficult to restrain rotational movement of the collar, in embodiments in which the stake is round, the internal void is also round.

The collar adjustment member comprises a projection portion that extends through a side through opening of the perimeter wall. In preferred embodiments, the side through opening extends through the central segment and is accessibly adjustable exterior to the collar by means of head portion. In the preferred embodiment, the adjustment member is a hex headed bolt. The side through opening is cooperatively threaded such that the bolt can be threaded a desired distance into the side through opening. A distal end of the projection portion is structured such that it can assist in securing the collar to the stake.

The guy line attachment member is structured and arranged to permit the guy line to be attached to the collar at one end and to a structure intended to be stabilized at the other. The guy line attachment member extends through a neck portion of the central segment. The neck portion, together with the guy line attachment member, angles downward towards the front. The guy line is attached to the guy line attachment member between the neck portion and a fastener such as a nut. In the preferred embodiment, the guy line is a chain. The threaded body portion is inserted into one of the link openings of the chain (preferably the endmost link) and secured with the fastener and washer.

The stake, which can be a T-post, is adapted to be slidingly positioned within the internal void, which, when viewed from the top, has a generally truncated diamond configuration defined by the perimeter wall having the same configuration.

In use, the second end of the guy line is attached to the structure intended to be stabilized with the guy line extending between the structure to the guy line attachment member to which the first end of the guy line is attached. The collar adjustment member is in a substantially retracted condition. The collar is then moved over an end of the stake such that stake is positioned within the internal void, and such that the stake left arm is located adjacent to a right junction (corner) of the perimeter wall, the stake right arm is located adjacent to a left junction (corner), and the stake leg is located adjacent to a distal junction (corner). When so positioned, the collar restricts relative lateral rotational movement of the stake and collar while still permitting linear movement of the collar along the length of the stake. When the collar is in a desired position on the stake, the adjustment member is threaded inward such that the distal end of the adjustment member contacts the spine between two adjacent stubs. Inward pressure exerted by the adjustment member on the spine helps maintain the collar in a fixed position on the stake. Additionally, even when the adjustment member does not come in contact with the spine, the adjustment member can restrict linear movement of the collar. This is because when the adjustment member is positioned between two adjacent stubs and threaded sufficiently inward such that the distal end of the adjustment member is positioned beyond tips of the stubs (nearer the spine than the tips), the two adjacent stubs prevent the adjustment member from passing the respective stub. When the distal end of the adjustment member is positioned outside the tips of the stubs (further from the spine than the tips), the collar is free to slide linearly along the length of the stake. Once the collar is placed in the desired position on the stake, the stake may be driven into the ground. This action will tighten the guy line to the desired tautness. Alternatively, the stake can be driven into the ground before positioning the collar on the stake. Multiple ground anchor assemblies may be used to secure the structure.

The collar dimensions may vary, depending on the dimensions of the stake. The stake of the preferred embodiment is a conventional and commercially available steel T-post and may vary in length. The stake is driven into the ground a sufficient distance so as to maintain stability of the post and structure when in use. With stakes comprising an anchor, the stake is preferably driven into the ground deep enough to completely bury the anchor. The guy line of the preferred embodiment is a steel chain but can comprise twine, rope, cord, cable, wire, etc. formed from any suitable natural or manmade material such as steel, nylon, polyester, Dacron, other suitable materials.

DESCRIPTION OF THE PREFERRED EMBODIMENT

Figure 1:
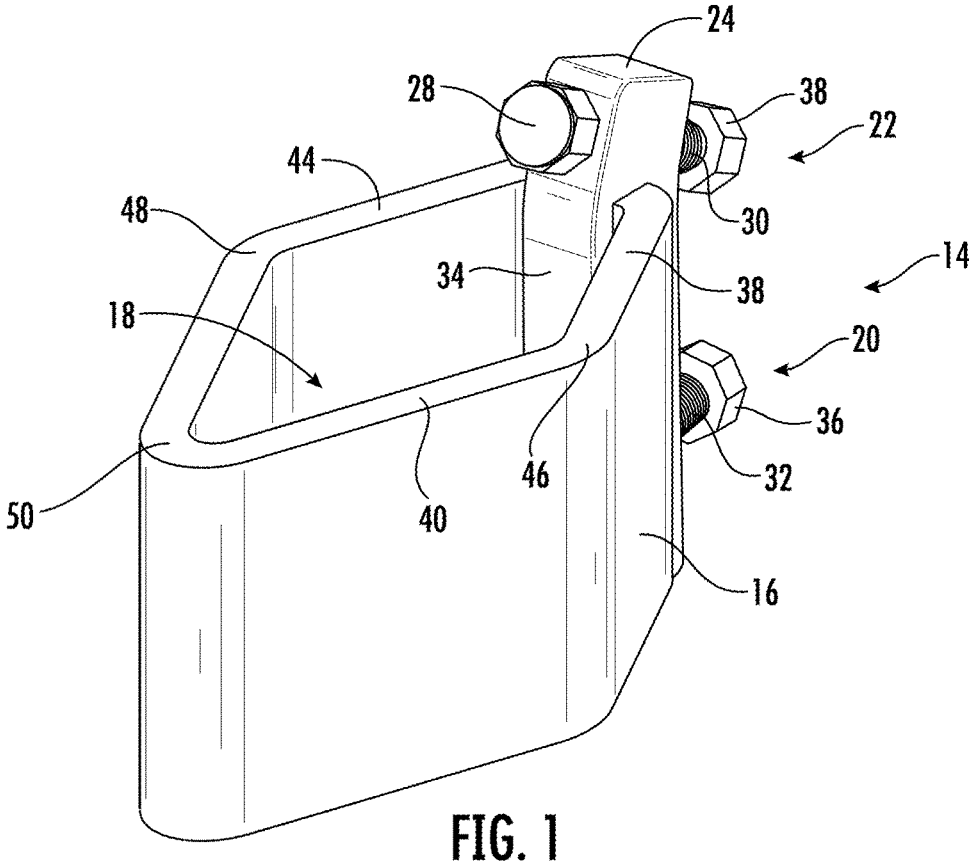
FIG. 1 is a rear, top, and left-side isometric view of the ground anchor collar, in accordance with a preferred embodiment.
Figure 2:
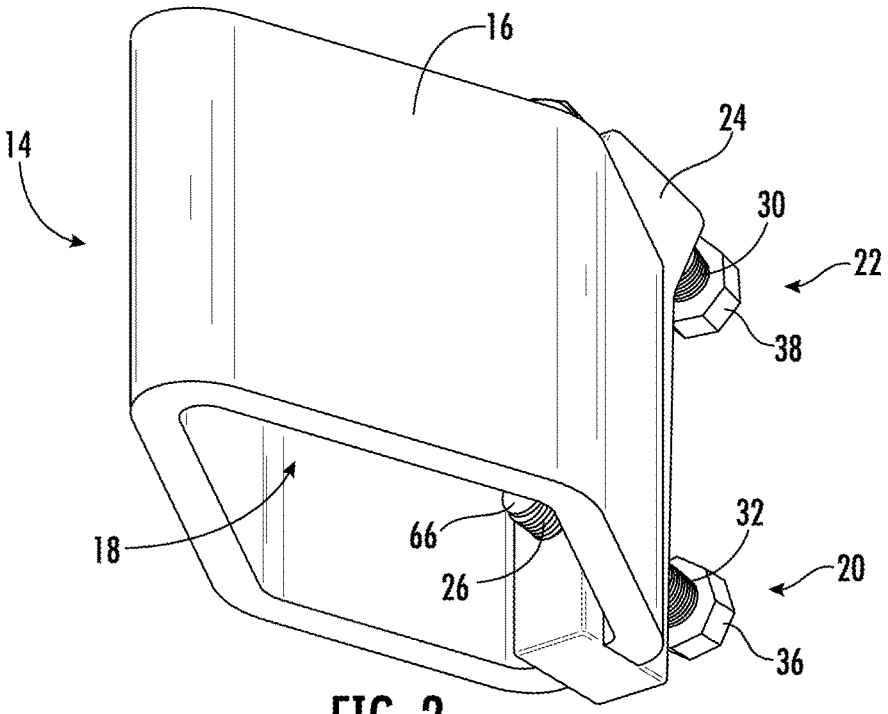
FIG. 2 is a rear, bottom, and left-side isometric view of the ground anchor collar of FIG. 1.

Referring to FIGS. 1-8, there is shown the ground anchor assembly 12 and parts thereof in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

Referring to the figures, the ground anchor assembly 12 of the preferred embodiment generally comprises a collar 14, a guy line 8, and a stake 6. The collar 14 of the preferred embodiment comprises a perimeter wall 16, an adjustment member 20, and a guy line attachment member 22. The perimeter wall 16 defines an internal void 18 adapted to receive and surround a perimeter of the stake 6. In preferred embodiments, inner surfaces of perimeter wall 16 are arranged to engage leg 56 and arms 58, 60 of a T-shaped stake 6. In the preferred embodiment, inner surfaces of the perimeter wall 16 restrain the collar 14 from substantial rotation relative to the stake 6. In other embodiments, the internal void 18 is shaped as a negative of the top end of the stake 6. Thus, for example, in embodiments in which the stake 6 is multisided, the internal void 18 may also be multisided. Though a round stake 6 is not preferred because it is more difficult to restrain rotational movement of the collar 14, in embodiments in which the stake 6 is round, the internal void 18 is also round.

Figure 3:
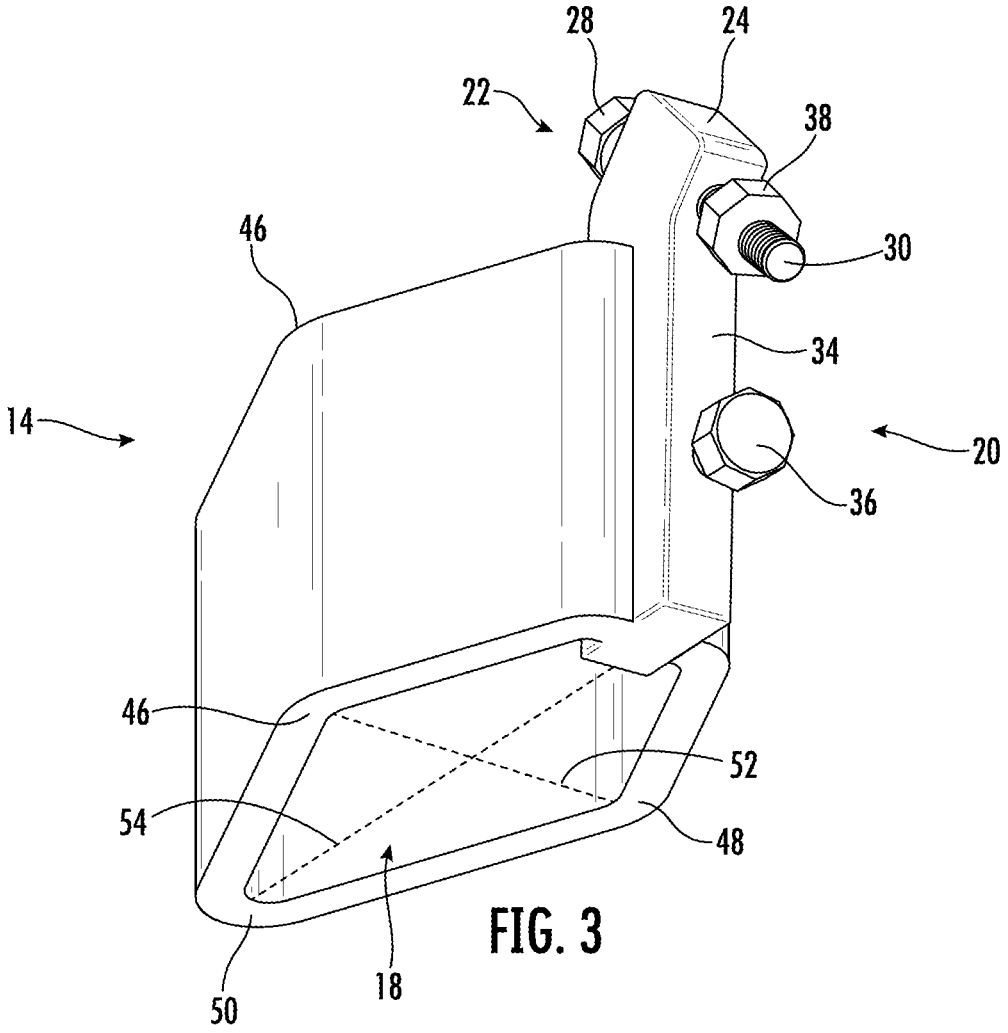
FIG. 3 is a front, bottom, and left-side isometric view of the ground anchor collar of FIGS. 1 and 2.

Referring to FIG. 1, in the preferred embodiment, the perimeter wall 16 comprises a central segment 34, left and right forward segments 38, 44, and left and right rearward segments 40, 42. The left and right forward segments 38, 44, each extend angularly rearward and outward from the central segment 34 to respective left and right junctions 46, 48 at which the left and right forward segments 38, 44, meet the respective left and right rearward segments 40, 42. The left and right rearward segments 40, 42 extend inward and rearward from the respective left and right junctions 46, 48, meeting at a distal junction 50. Referring to FIG. 3, in the preferred embodiment, an internal diameter 52 defined by the left and right junctions 46, 48, is lesser (shorter) than a co-planar internal diameter 54 defined by the central segment 34 and distal junction 52.

Although portions of the perimeter wall 16 are described herein as "segments", the perimeter wall 16 need not be formed from separate pieces of material. Rather, the perimeter wall 16 can be formed from one or multiple pieces of material. As used herein, the term "segments" refers to portions of the perimeter wall whether formed from a single piece or multiple pieces joined together.

The collar 6 adjustment member 20 comprises a projection portion 32 that extends through a side through opening 26 of the perimeter wall 16. In preferred embodiments, the side through opening 26 extends through the central segment 34 and is accessibly adjustable exterior to the collar 14 by means of head portion 36. In the preferred embodiment, the adjustment member 20 is a hex headed bolt. The side through opening 26 is cooperatively threaded such that the bolt can be threaded a desired distance into the side through opening 26. As will be discussed in more detail below, a distal end 66 of the projection portion 32 is structured such that it can assist in securing the collar 14 to the stake 6. Although the adjustment member 20 is described herein as a hex headed bolt threaded through the side through opening, the adjustment member need not be a hex headed bolt.

Rather, the adjustment member may comprise other arrangements which permit lateral pressure to be exerted onto the stake 6, such as, for example, a conventional and commercially available pull pin spring latch arrangement or ball lock pin arrangement. The adjustment member need not comprise a hex head, other head arrangements well known in the art can be used such as square, slotted, Allen/socket, washer, knurled, Phillips, Torx, and the like.

Figure 5:
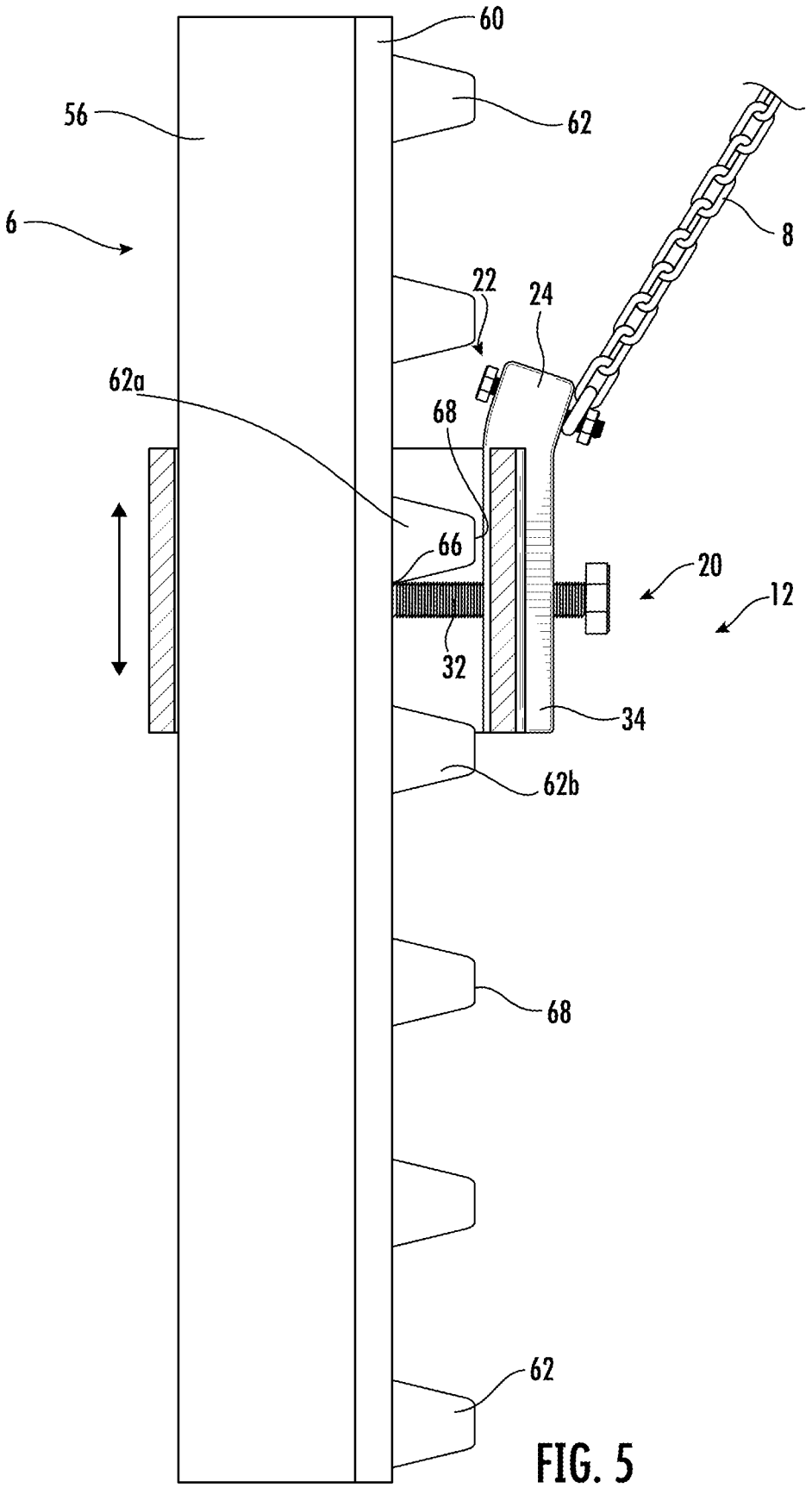
FIG. 5 is a left-side partial cutaway elevation view of the ground anchor assembly, in accordance with a preferred embodiment.

The guy line attachment member 22 of the preferred embodiment is structured and arranged to permit a first end 74 of the guy line 8 to be attached to the collar 6 and a second end 72 of the guy line 8 to be attached to a structure 70, such as, but not limited to, an elevated viewing platform 70 (FIG. 6), an elevated fuel tank and platform 76 (FIG. 7), or an airplane 78 (FIG. 8) intended to be stabilized. In preferred embodiments, the guy line attachment member 22 extends through a neck portion 24 of the central segment 34. The neck portion 24 extends above a plane defined by upper portions of the left and right forward and rearward segments 38, 44, 40, 42. When viewed from the side, as shown, for example, in FIG. 5, the neck portion 24 together with the guy line attachment member 22 angle downward towards the front. The guy line attachment member 22 of the preferred embodiment is a hex headed bolt comprising a head portion 28 and a threaded body portion 30 adapted to threadingly receive a nut 38. As shown in FIG. 5, guy line 8 is attached to the guy line attachment member 22 between the neck portion 24 and nut 38 or other fastener 38. In the preferred embodiment, the guy line 8 is a chain. The threaded body portion 30 is inserted into one of the link openings of the chain (preferably the endmost link) and secured with the nut 38 and washer (not shown). The guy line 8 can be attached to guy line attachment member at virtually any position on the guy line 8 and need not be attached at an extreme end.

Figure 4:
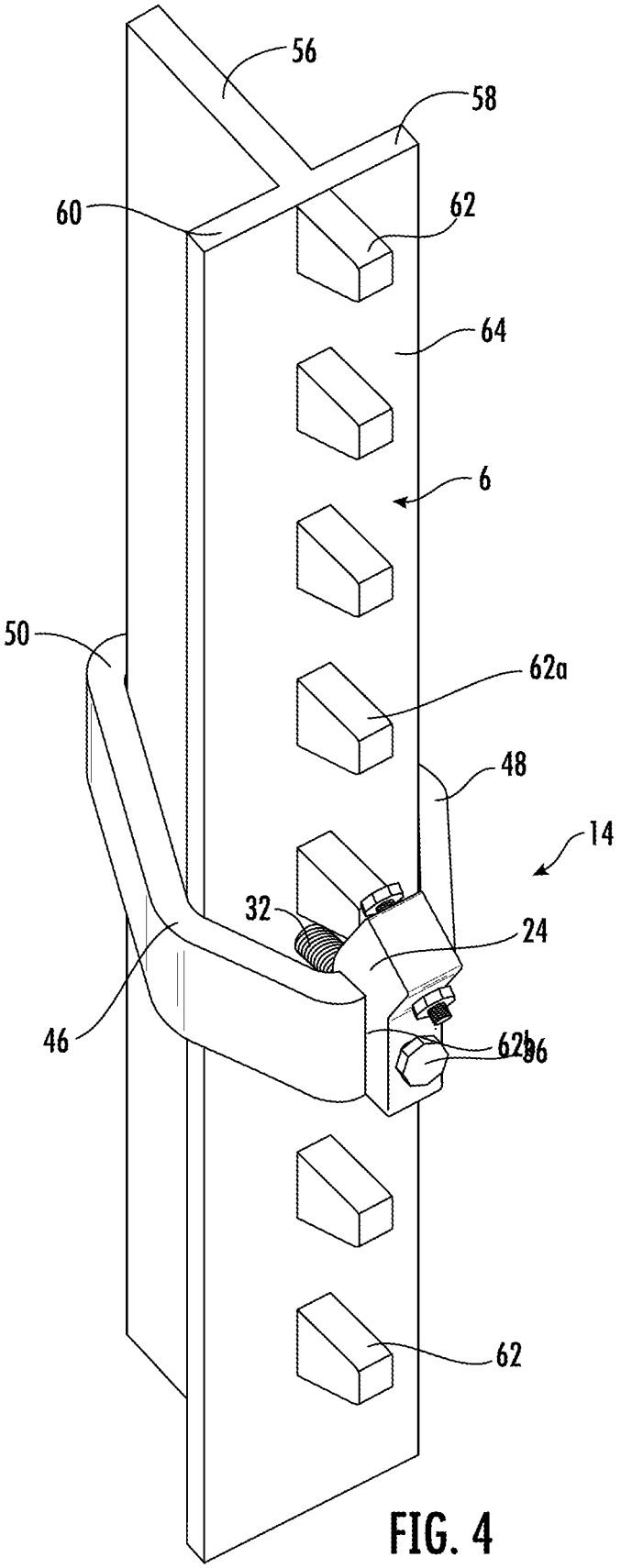
FIG. 4 is a front, top, and left-side isometric view of the ground anchor collar positioned on a T-post.

Referring to FIGS. 4 & 5, the stake 6 of the preferred embodiment comprises a "T" configuration, when viewed from the top, such that the stake 6 comprises the leg 56 positioned orthogonally between left and right arms 58, 60, the left and right arms 58, 60 defining a spine 64 of the stake 6. Positioned along and extending outward from the spine 64 are stubs 62. With this configuration, the stake 6 is adapted to be positioned within the internal void 18. The internal void 18, when viewed from the top, has a generally truncated diamond configuration defined by an inside/interior surface of the perimeter wall 16 having the same configuration. An exterior of the perimeter wall 16 need not have the same configuration as the interior. For example, the exterior my be round and the interior diamond shaped.

Figure 6:
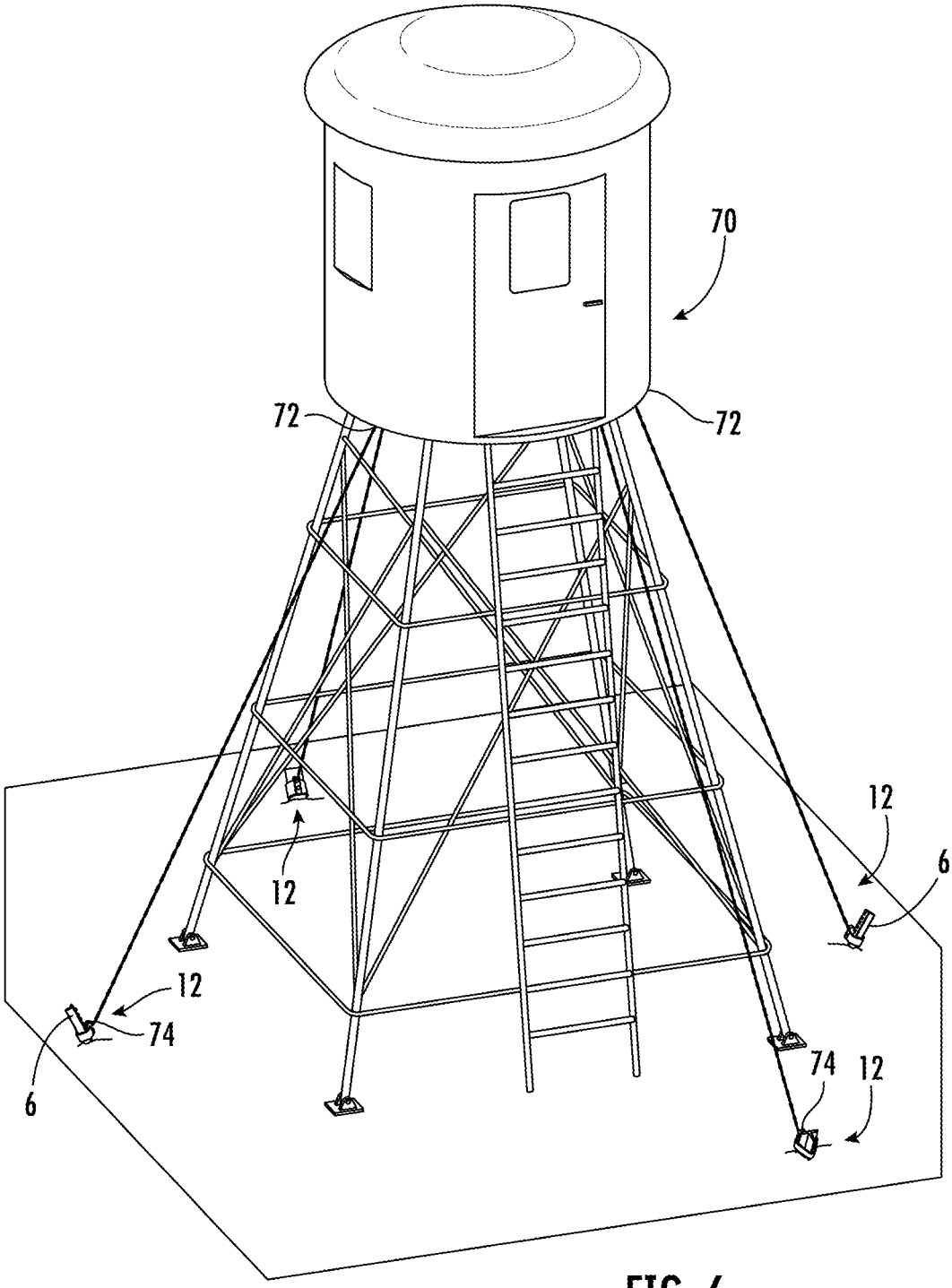
FIG. 6 is an isometric view of multiple ground anchor assemblies of preferred embodiments securing a structure such as an elevated platform.
Figure 7:
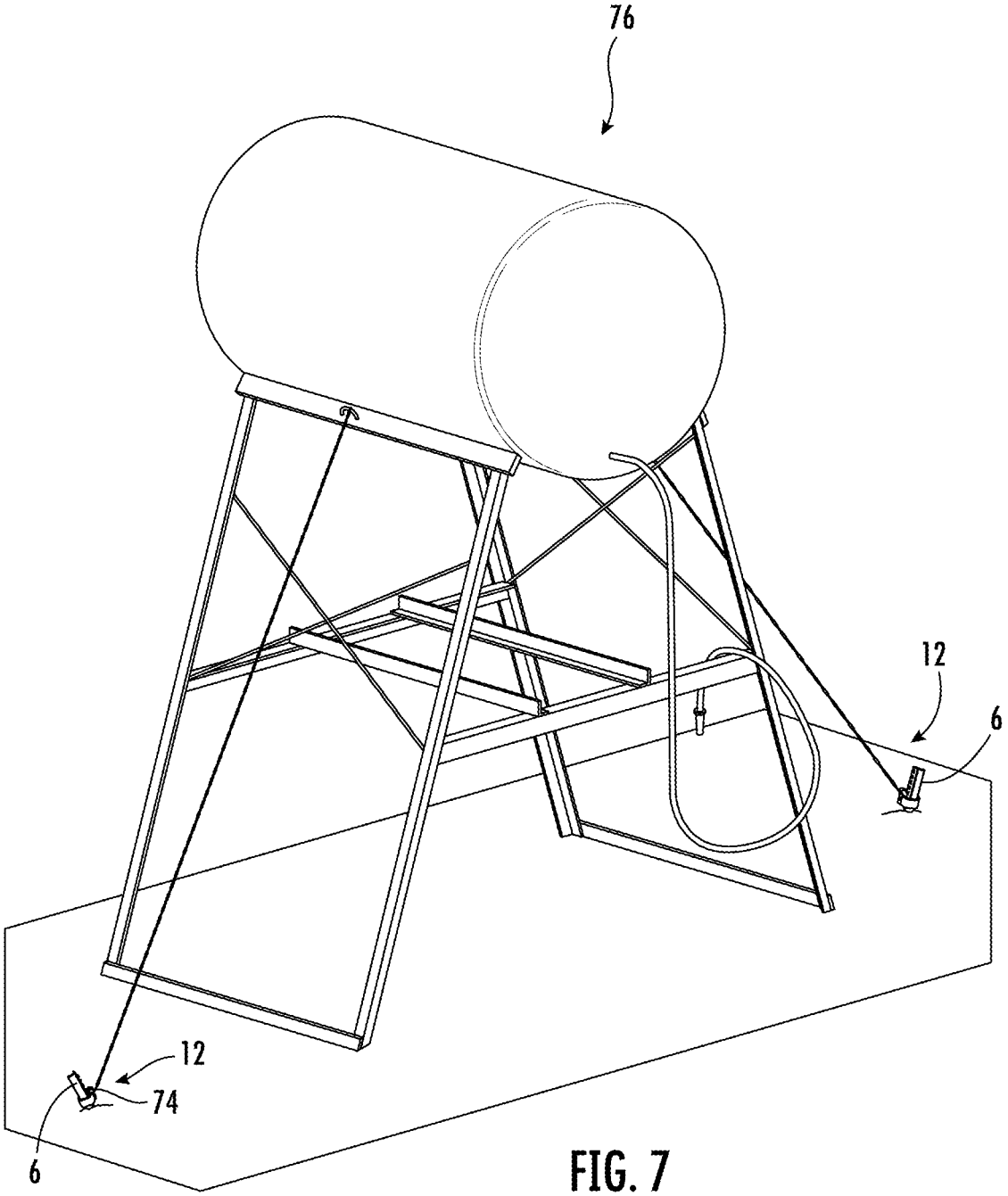
FIG. 7 is an isometric view of multiple ground anchor assemblies of preferred embodiments securing a structure such as an elevated fuel tank.
Figure 8:
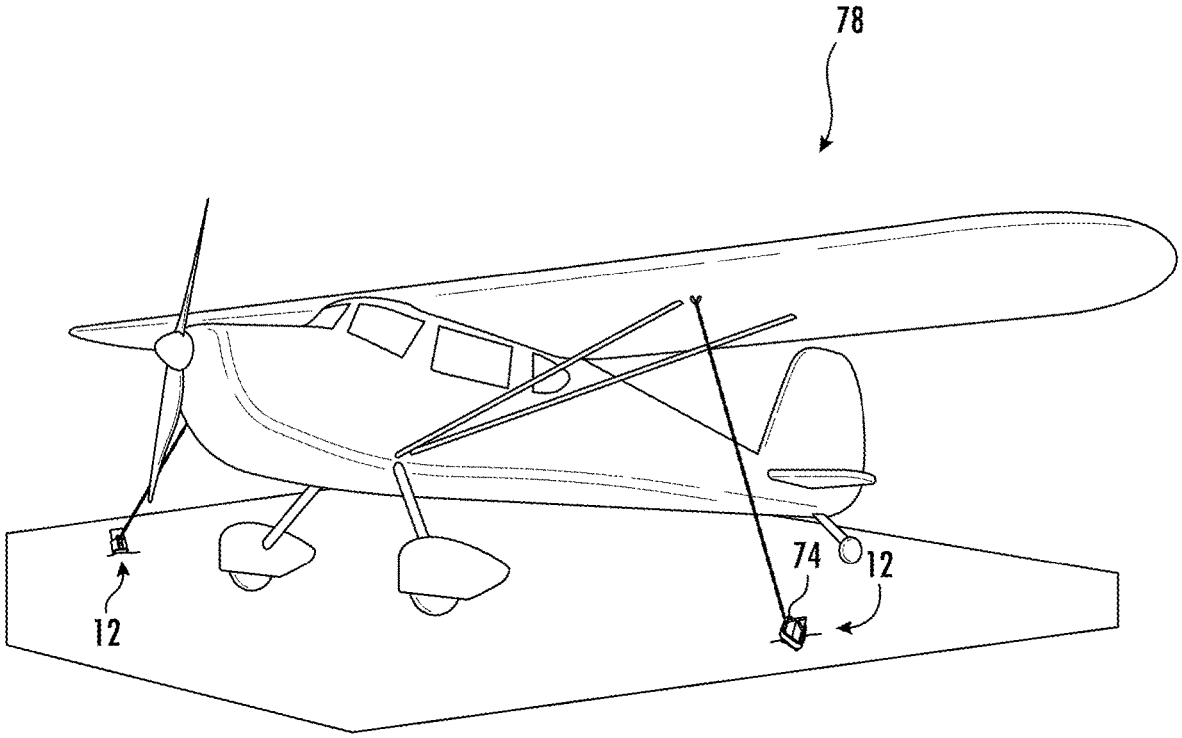
FIG. 8 is an isometric view of multiple ground anchor assemblies of preferred embodiments securing a structure such as an airplane.

A method of use of the ground anchor assembly 12 will now be described. The second end 72 of the guy line 8 is attached to the structure 70 intended to be stabilized. The guy line extends 8 between the structure 70 and the guy line attachment member 22. The first end 74 of the guy line 8 is attached to the guy line attachment member 22. The collar 6 adjustment member 22 is in a substantially retracted condition prior to the collar 14 being positioned on the stake 6. The collar 14 is then moved over an end of the stake 6 such that stake 6 is positioned within the internal void 18, as shown in FIG. 4, and such that the stake left arm 58 is located adjacent to the right junction 48 of the perimeter wall 16, the stake right arm 60 is located adjacent to the left junction 46, and the stake leg member 56 is located adjacent to the distal junction 50. When so positioned, the collar 14 restricts relative lateral rotational movement of the stake 6 and collar 14 around a central longitudinal axis of the stake 6 while still permitting linear movement of the collar 14 along the length of the stake 6. The collar 14 is then moved to a desired position along the length of the stake 6. When the collar 14 is in the desired position, the adjustment member 20 is threaded inward such that the distal end 66 of the adjustment member 20 contacts the spine 64 between two adjacent stubs 62*a*, 62*b*, as shown in FIG. 4. Inward pressure exerted by the adjustment member 20 on the spine 64 helps maintain the collar 14 in a substantially fixed position on the stake 6. Additionally, even when the adjustment member does not come in contact with the spine 64, the adjustment member can restrict linear movement of the collar 14. This is because when the adjustment member 20 is positioned between two adjacent stubs 62*a*, 62*b*, and threaded sufficiently inward such that the distal end 66 of the adjustment member 20 is positioned beyond tips 68 of the stubs 62 (nearer the spine 64 than the tips 68), the two adjacent stubs 62*a*, 62*b* prevent threaded body portion 30 from passing the respective stubs 62*a*, 62*b*. Thus, the collar 14, when the adjustment member 20 is so positioned, is restricted by the respective stubs 62*a*, 62*b* from linear movement beyond the adjacent stubs 62, 62. When the distal end 66 of the adjustment member 20 is positioned outside the tips 68 of the stubs 62 (further from the spine than the tips 68), the collar 14 is free to slide linearly along the length of the stake 6. Once the collar 14 is placed in the desired position on the stake 6, the stake 6 may be driven into the ground. This action will tighten the guy line 8 to the desired tautness. Alternatively, the stake 6 can be driven into the ground before positioning the collar 14 on the stake 6. As shown in FIG. 6, multiple ground anchor assemblies 12 may be used to secure the structure 70.

Although these measurements and materials may vary, in the preferred embodiment, the left and right forward segments 38, 44, and left and right rearward segments 40, 42 of the perimeter wall 16 are formed from ⅛ inch steel and have an approximate height of two (2) inches. The central segment 34 is formed from ⅝" square steel rod and has a height of approximately three (3) inches. The neck portion 24 is angled at approximately 15 degrees downward from horizontal. In the preferred embodiment the distance between the left and right junctions 46, 48 (the length of internal diameter 52 defined by the left and right junctions 46, 48) is approximately 1½ inches. The distance between the central segment 34 and distal junction 50 (the length of internal diameter 54 defined by the central segment 34 and distal junction 50) is approximately 1¾ inches.

The collar 14 dimensions may vary, depending on the dimensions of the stake 6. The stake 6 of the preferred embodiment is a conventional and commercially available steel T-post having a depth of approximately 1½ inches and width approximately 1¼ inches. The stake 6 of the preferred embodiment may vary in length. In preferred embodiments, the length ranges from 1-6 feet. The stake 6 is driven into the ground a sufficient distance so as to maintain stability of the post and structure when in use. In most cases, the stake is preferably driven into the ground 18-24 inches. With stakes 6 comprising an anchor, the stake 6 is driven into the ground deep enough to completely bury the anchor. The stake 6 can be driven into the ground vertically or at an angle.

The guy line 8 of the preferred embodiment is a steel chain comprising approximately 1¼ inch links. Although the guy line 8 of the preferred embodiment comprises steel chain, the guy line 8 need not be a steel chain. Rather, the guy line 8 can comprise twine, rope, cord, cable, wire, etc. formed from any suitable natural or manmade material such as other metals, nylon, polyester, Dacron, and other suitable materials.

DISCLOSURE NOT TO BE LIMITED

While there has been illustrated and described what is, at present, considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of this disclosure.

I claim:

1. A ground anchor assembly comprising:

a collar, a stake, and a guy line attachment member, the guy line attachment member being adapted to be coupled to a guy line;

a neck portion, the neck portion comprising the guy line attachment member;

the collar comprising a perimeter wall and an adjustment member;

the perimeter wall defining an internal void structured and arranged to receive a portion of the stake such that when the portion of the stake is positioned within the internal void, the perimeter wall surrounds a perimeter of the portion of the stake and restrains rotational movement of the collar relative to the stake;

the neck portion and the guy line attachment member being angled downward with respect to a plane defined by top portions of the perimeter wall;

the adjustment member being moveable from a first position to a second position, the first position being one in which, when the portion of the stake is positioned within the internal void, a distal end of the adjustment member does not contact the stake, the second position being one in which, when the portion of the stake is positioned within the internal void, the distal end of the adjustment member contacts the stake.

2. The ground anchor assembly of claim 1, wherein the stake is a t-post.

3. The ground anchor assembly of claim 2, wherein the internal void comprises a diamond configuration, when viewed from above.

4. The ground anchor assembly of claim 3, wherein the distal end of the adjustment member contacts the stake between adjacent stubs of the stake.

5. The ground anchor assembly of claim 1, wherein the adjustment member is a threaded bolt adapted to be threaded through a side through opening of the perimeter wall.

6. A collar for use in a ground anchor assembly, the collar comprising:

a perimeter wall, an adjustment member, a guy line attachment member, and a neck portion, the neck portion comprising the guy line attachment member, the neck portion and guy line attachment member being angled downward with respect to a plane defined by top portions of the perimeter wall;

the guy line attachment member being structured and arranged to be coupled to a guy line;

the perimeter wall defining an internal void structured and arranged to receive a portion of a stake such that when the portion of the stake is positioned within the internal void, the perimeter wall surrounds a perimeter of the portion of the stake and restrains rotational movement of the collar relative to the stake;

the adjustment member being moveable from a first position to a second position, the first position being one in which, when the portion of the stake is positioned within the internal void, a distal end of the adjustment member does not contact the stake, the second position being one in which, when the portion of the stake is positioned within the internal void, the distal end of the adjustment member contacts the stake.

7. The collar of claim 6, wherein the stake is a T-post.

8. The collar of claim 7, wherein the internal void comprises a diamond configuration.

9. The collar of claim 7, wherein, when the adjustment member is in the first position, the distal end of the adjustment member contacts the stake between adjacent stubs of the stake.

10. The collar of claim 6, wherein the guy line is a chain.

11. The collar of claim 6, wherein the adjustment member is a threaded bolt adapted to be threaded through a side through opening of the perimeter wall.

* * * * *